United States Patent [19]

Sanbe

[11] Patent Number: 4,746,916

[45] Date of Patent: May 24, 1988

[54] METHOD OF AND AN APPARATUS FOR DISPLAYING A PICTURE

[75] Inventor: Yukiharu Sanbe, Tokyo, Japan

[73] Assignee: Taito Corporation, Tokyo, Japan

[21] Appl. No.: 45,762

[22] Filed: Apr. 30, 1987

Related U.S. Application Data

[63] Continuation of Ser. No. 580,603, Feb. 16, 1984, abandoned.

[30] Foreign Application Priority Data

Feb. 28, 1983 [JP] Japan ..... 58-031018

[51] Int. Cl.[4] ..... G09G 1/14

[52] U.S. Cl. ..... 340/744; 340/721; 340/731; 340/732; 340/727; 358/242; 273/85 G

[58] Field of Search ..... 340/744, 739, 720, 721, 340/727, 731, 732; 315/378; 358/260, 285, 289, 242; 273/85 G, DIG. 28

[56] References Cited

U.S. PATENT DOCUMENTS

| | | | |
|---|---|---|---|
| Re. 31,200 | 4/1983 | Sukonick et al. | 340/731 |
| 2,469,895 | 5/1949 | Rogers | 315/378 |
| 3,006,994 | 10/1961 | Spiegel | 315/378 |
| 3,380,028 | 4/1968 | Gustafson et al. | 340/721 |
| 3,980,926 | 9/1976 | Kruegar | 340/732 |
| 4,128,838 | 12/1978 | Brands et al. | 343/556 |
| 4,412,220 | 10/1983 | Aanstcot et al. | 343/556 |
| 4,415,928 | 11/1983 | Strolle et al. | 340/727 |

OTHER PUBLICATIONS

Japanese Disclosure Document Tokkai 57-146, 177, published 1952.

Japanese Disclosure Document Tokkai 49-118325, published 1974.

Journal of the Institute of Television Engineers of Japan, vol. 32, No. 9 (1978) pp. 771-776.

Japanese Disclosure Document Tokkai 46-5573, Dec. 1, 1976.

L'onde Electrique, vol. XXIV, No. 332 (Nov. 1954), Numero Special Consacre a La Television pp. 838 to 841.

*Primary Examiner*—Gerald L. Brigance

*Attorney, Agent, or Firm*—Hall, Myers & Rose

[57] ABSTRACT

In a method of displaying a picture according to the present invention, at least one starting point is determined on a picture screen; a picture is produced on a spiral raster which diverges from or converges toward each of the starting points; a shape, phase, linear density, and scanning speed of each spiral raster are controlled; thereby the patterns displayed on the screen are moved, rotated, enlarged, reduced, or modified.

The central position of this spiral raster is given by setting deflection control signals in the X and Y directions of an electron beam into fixed values. The spiral raster is given by adding sine waves whose amplitudes gradually increase or decrease to the above deflection control signals.

When the frequencies of the deflection control signals are constant, the scanning is performed at a constant angular velocity. On the other hand, when the frequencies are changed in proportion to the amplitudes, the scanning can be done at a constant speed.

20 Claims, 2 Drawing Sheets

METHOD OF AND AN APPARATUS FOR DISPLAYING A PICTURE

This is a continuation of application Ser. No. 580,603, filed Feb. 16, 1984 and now abandoned.

FIELD OF THE INVENTION

This invention relates to a method and an apparatus for displaying a picture by scanning an electron beam along a spiral raster on a screen in the case where a picture is displayed by the steps of: scanning on the screen such as a cathode ray tube by the electron beam; changing intensity of the electron beam which changes the luminance of each light spot to be generated on the screen. More concretely, this invention relates to a method of producing a pattern on the screen of a video gaming machine and the like by the above-mentioned spiral raster scanning method and of very freely moving, rotating, modifying, enlarging or reducing that pattern at any time, and to an apparatus for embodying the method.

BACKGROUND OF THE INVENTION

In video gaming machines, it is necessary to display many kinds of characters or patterns on a screen and to move, rotate, modify, enlarge or reduce these characters or patterns on the basis of a predetermined program and rule for a game, thereby to develop the required process of the game.

One well-known method of generating those patterns is to use a parallel raster scanning method which is similar to the case of a standard TV receiver, and the other one is a random scanning or vector generating method.

In the former method, each scan line is divided into a number of picture display elements and the luminance of each picture element is controlled; as a result, a picture is displayed as a mosaic pattern consisting of a series of picture elements along the scan line.

With this method, therefore, colorful patterns suitable for a gaming machine can be easily constituted since these patterns are displayed as a combination of various color images. However, in this method, although the generated patterns can be easily moved horizontally and vertically on the screen, there is the problem that a high-speed processing unit and a relatively large capacity memory are needed to rotate, enlarge or reduce these patterns.

Even in the case of an extremely simple pattern, e.g. a square and the like, if one desires to smoothly rotate this pattern, a processing unit which is too advanced and expensive to be used in a gaming machine is required. In other words, it is impossible to smoothly perform the rotation, enlargement, reduction, etc. of a complicated pattern at a high speed by a cheap processing circuit which can be adopted for a raster scan gaming machine; therefore, there is a problem in that, for example, the rotational movement has to be represented by an approximate rotational movement based on the discontinuous rotational indication such that the pattern jumps and is displayed at intervals of, say, 30 degrees of rotational angle or the like.

In the latter random scanning method, the X-Y deflection angles of the electron beam are controlled without using any raster, thereby drawing a line image on the screen.

With this method, since a pattern is displayed as an aggregate of a relatively small number of straight lines, i.e. vectors to be displayed on the screen, little computational effort is necessary to rotate, enlarge and reduce the pattern. Thus, the pattern can be smoothly rotated, enlarged and reduced at high speed even by a low-speed processing unit of small capacity. However, displayed patterns are limited to simple line drawings consisting of a relatively small number of straight lines or to a hollow outline drawing without any filled-in color areas; therefore, there is a problem in that the displayed pattern lacks substance and brilliance and that this may diminish interest in the game.

Spiral scanning of a cathode ray tube is old. For example the article Various Characteristics of the Equal Angular Velocity Spiral Scanning Television published in the Journal of the Institute of Television Engineers of Japan, Vo. 32, no. 9 (1978) teaches a television having spiral scanning.

SUMMARY OF THE INVENTION

It is an object of the present invention, therefore, to provide a novel method of and an apparatus for displaying a picture whereby a brilliant picture similar to the raster scanning method can be freely moved, rotated, enlarged, and reduced using a processing circuit of a scale of complexity and cost which is almost equal to that in the random scanning method.

The gist of the present invention is that: at least one starting point is determined on the screen; pictures are produced on spiral rasters which diverge from each of the above-mentioned starting points or which converge to each of the starting points; the shapes, phases, linear densities, and scanning speeds of each of those spiral rasters are controlled; thereby the patterns displayed on the screen are moved, rotated, enlarged, reduced or modified.

The central position of this spiral raster is given by setting deflection control signals in the X and Y directions of the electron beam into fixed values. The spiral raster is produced by adding a sine wave whose amplitude gradually increases or decreases to the above-mentioned deflection control signals.

Assuming that the frequencies of the deflection control signals are constant, the scanning operation is performed at a constant angular velocity. On the other hand, if the frequencies are changed in inverse proportion to the amplitudes, the scanning operation can be done at a constant velocity.

In a preferred embodiment of the present invention, the spiral raster is divided into a number of segments and a peculiar address and a luminance data corresponding to its address are given to each segment respectively, thereby forming a video signal to control an intensity of the electron beam and controlling the intensity of the electron beam for every segment synchronously with the scanning operation, and as a result of it, the luminance of the above segment is controlled and a pattern is displayed.

It is well known that the cathode ray tube of a television receiver may be spirally scanned and a picture generated on the screen by its electron beam, however this type ofscanning has not yet been put to practical use.

In a known spiral raster scanning TV, the picture is scanned along a circular or elliptical spiral which diverges outwardly from the central point of the CRT screen or which converges inwardly toward the central point of the screen from the outside, thereby forming a picture on the whole screen or its central portion which is similar to the picture that will be displayed by an ordinarily parallel line raster scanning method. On the contrary, a technology is not yet known whereby particular patterns or characters can be generated in required positions at any time and their movement, rotation, etc. are preformed by controlling the phase or the like of the sine wave signal for deflecting the electron beam.

In the polar coordinate system(r,$\theta$), such a spiral raster as described above is represented by following expression (1)

$$r=C(\theta-\beta) \tag{1}$$

wherein C and $\beta$ are constants.

If $\beta=0$ in expression (1), and r, $\theta$ and C are replaced as $$r=R_0\cdot t$$

$$\theta=\omega_0\cdot t \tag{2}$$

$$C=R_0/\omega_0$$

where $R_0$ and $\omega_0$ are constants and t is a time; the scanning operation is performed at a constant angular velocity.

The linear velocity, can be expressed as $$V=\sqrt{\left(\frac{d\gamma}{dt}\right)^2+\left(\gamma\frac{d\theta}{dt}\right)^2} \tag{3}$$

If V is constant, the scanning operation is done at a constant speed.

Expression (3) can be also written as:

$$\begin{aligned} V &= \frac{1}{C}\sqrt{C^2+r^2}\ \frac{d\gamma}{dt} \\ Vt &= \int_0^t V dt = \int_0^\gamma \frac{1}{C}\sqrt{C^2+\gamma^2}\ d\gamma \\ &= \frac{1}{2C}\left[\gamma\sqrt{C^2+r^2}+C^2\cdot\log\left(r+\sqrt{C^2+r^2}\right)\right]_0^\gamma \\ &= \frac{1}{2C}\left(\gamma\sqrt{C^2+r^2}+C^2\cdot\log\frac{r+\sqrt{C^2+r^2}}{C}\right) \end{aligned} \tag{4}$$

It can be understood from expressions (1) and (4) that the scanning operation is performed. at a constant velocity.

These scanning operations can be realized when signals X(t) and Y(t) for deflecting the electron beam in the X and Y directions are represented by following expressions, (5) or (6)

$$X(t)=X_0+F_1(t)\cdot\sin\left[\omega_1(t)\cdot t+\beta_1\right]$$

$$Y(t)=Y_0+F_1(t)\cdot\sin\left[\omega_2(t)\cdot t+\beta_2\right] \tag{5}$$

$$X(t)=X_0+F_2(t)\cdot\sin\left[\omega_1(t)\cdot(t_0-t)+\beta_1\right]$$

$$Y(t)=Y_0+F_2(t)\cdot\sin\left[\omega_2(t)\cdot(t_0-t)+\beta_2\right] \tag{6}$$

wherein $X_0$, $Y_0$, $\Gamma_1$, and $\Gamma_2$ are constants, t is time ($0\leqq t\leqq t_0$), and $F_1(t)$, $F_2(t)$, $\omega_1(t)$, and $\omega_2(t)$ are functions of time.

The figures to be produced on the basis of the above-mentioned expressions (5) and (6) are generally the Lissajous' figures which changes in a complex manner as the time passes. However, only the simplest circular spiral raster will be dealt with hereinafter.

It is now assumed that $$\beta_1=\beta_2+\pi/2$$

$$\beta_2=\beta$$

$$F_1(t)=F_2(t)=F(t)$$

$$\omega_1(t)=\omega_2(t)=\omega_{(t)}$$

Furthermore, when F(t) is a monotonic increasing function and $\omega(t)$ is a constant, expression (5) provides a spiral raster which diverges from the point ($X_0$, $Y_0$) and expression (6) provides a spiral raster which converges to the point ($X_0$, $Y_0$).

The point ($X_0$, $Y_0$) is the central point of the spiral raster and the spiral raster together with the pattern can be in parallel motion by sequentially changing the values of these $X_0$ and $Y_0$. The pattern can be rotated around the central point of the spiral raster by changing the phase difference of the sine wave signal portion. The raster can be modified from circle to ellipse and further to a linear shape, and vice versa by changing the phase difference ($\beta_1-\beta_2$). Furthermore, the pattern displayed can be enlarged, reduced, or modified by controlling the amplitudes $F_1(t)$ and $F_2(t)$.

The spiral raster disclosed in the present invention is not limited to the spiral shown by the foregoing expressions. However, it is possible to use a pseudo-spiral which is constituted by combining circular arcs as will be described later, —shaped or elliptic spiral, and other more complicated spirals whose interlinear distances or the like are not constant.

The objects and constitutions of the present invention described above will become more apparent from the following detailed description referring to the accompanying drawings.

DETAILED DESCRIPTION OF THE PREFERRED EMBODIMENTS

Figure 1:
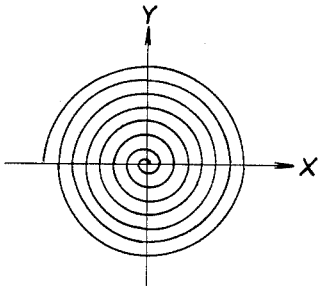
FIGS. 1 and 2 are plan views showing examples of spiral rasters to be produced from the above-mentioned expression (5) or (6)
Figure 2:
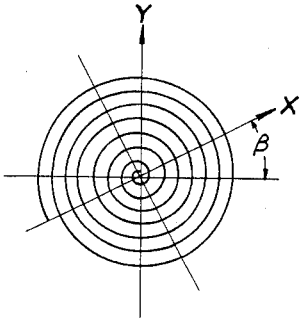

The circular spiral rasters in FIGS. 1 and 2 are obtained as follows.

That is, in expression (5), assuming that $$\begin{aligned} F_1(t) &= F_2(t) \\ &= F_0(t) \\ \omega_1(t) &= \omega_2(t) \\ &= \omega_0 = \text{constant} \end{aligned}$$

$$\beta_1=\beta_2+\pi/2$$

$$\beta_2=\beta$$

expression (5) will be $$X(t)=X_0F_0\cdot(t)\cdot\cos[\omega_0\cdot t+\beta]$$

$$Y(t)=Y_0+F_0\cdot(t)\cdot\sin[\omega_0\cdot t+\beta] \quad (7)$$

Expressions (7) represent a circular pattern in which the radius increases in proportion to time. This appears as a spiral raster which diverges from the point ($X_0$, $Y_0$). $2\pi F_0/\omega_0$ is the radial distance between successive turns of the spiral and $\beta$ is a parameter indicative of its phase.

When $\beta=0$, the spiral raster is as shown in FIG. 1 and when $\beta\neq 0$, it is as shown in FIG. 2.

Now, assuming that $$\begin{aligned}\beta &= \beta(t)\\ &= \Omega\cdot t\\ \Omega &= \text{constant} > 0\end{aligned}$$

the spiral raster rotates in the positive direction (counterclockwise in the drawings) at a constant angular velocity $\Omega$.

Although a similar spiral raster is obtained from expression (6), in this case, the point [X(t), Y(t)] begins at the outermost part of the spiral and moves toward the central point ($X_0$, $Y_0$).

Figure 3:
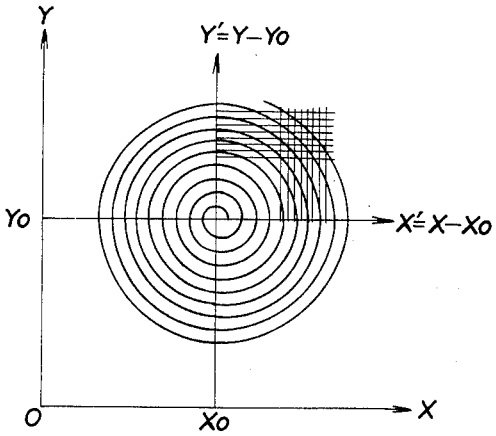
FIGS. 3 and 4 are plan views showing examples of pseudo-spiral rasters consisting of circular arcs.
Figure 4:
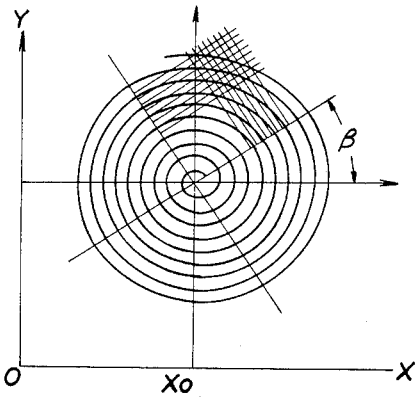

On the other hand, the spiral rasters consisting of the combinations of circular arcs which are shown in FIGS. 3 and 4 are obtained as follows.

In expression (5), assuming that $$\begin{aligned}F_1(t) &= F_2(t)\\ &= F_0\\ \omega_1(t) &= \omega_2(t)\\ &= \omega_0\\ &= \text{constant}\\ \beta_1 &= \frac{\pi}{2}\\ \beta_2 &= 0\\ X_0 &= X_0 + x_0\end{aligned}$$

then we obtain $$X(t)=X_0+x_0+F_0\cdot\cos[\omega_0\cdot t]$$

$$Y(t)=Y_0+F_0\cdot\sin[\omega_0\cdot t] \quad (8)$$

These are equations of circular vibration around the point ($X_0+x_0$, $Y_0$).

It is now assumed that $\frac{\pi}{\omega_0} = T$ and

| | |
|---|---|
| when $t = 0$; assumed that | $F_0 = 0$ |
| when $0T < t \leqq 1T$; | $F_0 = 1\cdot\Delta F$ |
| when $1T < t \leqq 2T$; | $F_0 = 2\cdot\Delta F$ |
| when $2T < t \leqq 3T$; | $F_0 = 3\cdot\Delta F$ |
| when $3T < t \leqq 4T$; | $F_0 = 4\cdot\Delta F$ |
| when $(n-1)T < t \leqq nT$; | $F_0 = n\cdot\Delta F$ |
| when $(N-1)T < t \leqq NT = t_0$; | $F_0 = N\cdot\Delta F = D$ |
| and also when $n = 0$; assume that | $x_0 = 0$ |
| when $n$ is an odd number; | $x_0 = 0$ |
| when $n$ is an even number; | $x_0 = -\frac{\Delta F}{2}$ |

As a result of this, the spiral raster shown in FIG. 3 is obtained.

This spiral raster consists of semicircular arcs of which the radius increases up to F at every semicircle. In FIG. 3, the center of the semicircular arc in the area of $$Y'=Y-Y_0>0$$

locates at ($X_0$, $Y_0$), and the center of the semicircular arc in the area of $$Y'=Y-Y_0>0$$

locates at ($X_0-\Delta F/2$, $Y_0$).

This spiral is such that the radial distance between successive turns of the spiral is $\Delta F$ and the angular velocity for the central point [X(t), Y(t)] which moves along the spiral raster is a constant value $\omega_0$ and that the speed at which that point leaves from the central point is $\Delta F\cdot\omega_0/2\pi$.

This spiral raster moves in association with continuous changes of $X_0$ and $Y_0$ in the above expressions as functions of the time substantially similar to that shown in FIGS. 1 and 2.

In addition, although $\beta=0$ in FIG. 3, this $\beta$ is a constant to determine the phase of the spiral raster. For example, in place of expression (8), assuming that $$X(t)=X_0+x_0+F_0\cdot\cos[\omega_0\cdot t+\beta]$$

$$Y(t)=Y_0+F_0\cdot\sin[\omega_0\cdot t\beta] \quad (9)$$

as shown in FIG. 4, the spiral raster which is rotated by the angle $\beta$ against the spiral raster shown in FIG. 3 is obtained.

Therefore, when $$\begin{aligned}\beta &= \beta(t)\\ &= \Omega\cdot t\\ &= \text{constant} > 0\end{aligned}$$

the spiral raster rotates in the positive direction (counterclockwise in FIG. 4) at a constant angular velocity $\Omega$.

In the above expression, $\Delta F$ is a constant to determine not only an interlinear distance but also a divergent rate of the spiral raster and a maximum diameter at $t=t_0$.

However, as described above, since the angular velocity of the scan is constant under the condition of $$\omega_1(t)=\omega_2(t)=\text{constant},$$

the speed of the luminescent spot on the CRT becomes faster in proportion to the distance from the point ($X_0$, $Y_0$), so that a problem occurs in that when a large pattern is drawn, the brightness at the peripheral portion is reduced. It is possible to increase the intensity of the electron beam synchronously with the scanning, to maintain constant brightness. It is also possible to set the speed of the luminescent spot itself to be constant as will be described hereinbelow.

Namely, assuming that $$\begin{aligned}\omega_1(t) &= \omega_2(t)\\ &= \omega(t)\end{aligned}$$

and further when $\omega(t)$ is $$\begin{aligned}&\sqrt{[X(t)-(X_0+x_0)]^2+[Y(t)-Y_0]^2}\cdot\omega(t)\\ &= V\\ &= \text{constant}\end{aligned}$$

the point [X(t), Y(t)] can be moved at a constant tangential velocity.

That is to say,

| | |
|---|---|
| when $t=0$; assumed that | $\omega(t)=0$ and $F_0=0$ |
| when $0<\omega(t)\cdot t\leqq 1$; | $\omega(t)=\frac{V}{1\cdot\Delta F}$ and $F_0=1\cdot\Delta F$ |
| when $1\pi<\omega(t)\cdot t\leqq 2$; | $\omega(t)=\frac{V}{2\cdot\Delta F}$ and $F_0=2\cdot\Delta F$ |
| when $2\pi<\omega(t)\cdot t\leqq 3$; | $\omega(t)=\frac{V}{3\cdot\Delta F}$ and $F_0=3\cdot\Delta F$ |
| when $3\pi<\omega(t)\cdot t\leqq 4$; | $\omega(t)=\frac{V}{4\cdot\Delta F}$ and $F_0=4\cdot\Delta F$ |
| when $4\pi<\omega(t)\cdot t\leqq 5$; | $\omega(t)=\frac{V}{5\cdot\Delta F}$ and $F_0=5\cdot\Delta F$ |
| when $(n-1)\pi<\omega(t)\cdot t\leqq n\pi$; | $\omega(t)=\frac{V}{n\cdot\Delta F}$ and $F_0=n\cdot\Delta F$ |
| when $(N-1)\pi<\omega(t)\cdot t\leqq N\pi$; | $\omega(t)=\frac{V}{N\cdot\Delta F}$ and $F_0=N\cdot\Delta F$ |
| and when $n=0$; assumed that | $x_0=0$ |
| when $n$ is an odd number; | $x_0=0$ |
| when $n$ is an even number; | $x_0=-\frac{\Delta F}{2}$, |

the spiral raster of the constant linear velocity type of which the point [X(t), Y(t)] moves at a constant tangential velocity V is obtained.

Furthermore, in expression (5), when $$\beta_1=\beta_2=0$$

the linear vibration is obtained. Therefore, by changing $X_0$ and/or $Y_0$, the partial parallel line raster can be obtained.

Although this is not a spiral raster, this raster can be generated by the apparatus of the present invention and it has an effect similar to that of the present invention.

As described in the above, according to a method of the present invention, it will be appreciated that electron beam deflection signals in the X and Y directions are generated by sine waves where amplitudes and/or frequency change.

Such a sine wave signal method not only causes a saw tooth wave generator and a synchronizing signal which are indispensable for an ordinary parallel line raster to become unnecessary but also allows the electron beam to be easily deflected.

Such a sine wave in which the amplitude and/or frequency fluctuates can be easily obtained by an analog technique such as an amplitude modulation, frequency modulation, or the like or by a hybrid technique such as pulse width modulation or the like from an ordinary sine wave or square wave pulse train. A desirable method, is by coding a desired function X(t) and providing a read-only-memory (ROM) and reading it out when desired and using it as a control signal.

These functions X(t) and Y(t), are determined such that, for example, $$X_1(t)=\cos t$$

$$Y_1(t)=\sin t$$

$$X_2(t)=Y_2(t)=t$$

$$X(t)=X_1(t)\cdot X_2(t)$$

$$Y(t)=Y_1(t)\cdot Y_2(t)$$

When this is further coded, and recorded as data on the ROM; for example, using values of $X_1(t)$, $X_2(t)$, $Y_1(t)$, and $Y_2(t)$ corresponding to $$t=n\cdot\Delta t$$

(wherein n is an integer). Each value is recorded at a specific address on the ROM to allow its recovery and use when required.

The above-mentioned expressions can be rewritten as follows.

$$X_1(t)=\cos[n\cdot\Delta t]$$

$$Y_1(t)=\sin[n\cdot\Delta t]$$

$$X_2(t)=Y_2(t)=n\cdot\Delta t$$

$$X(t)=X_1(t)\cdot X_2(t)=x_1(n)\cdot x_2(n)$$

$$Y(t)=Y_1(t)\cdot Y_2(t)=y_1(n)\cdot y_2(n)$$

The spiral raster located in the desired location shown in FIG. 1 is readily obtained by the above expressions. On the other hand, in order to generate the rotated spiral raster as shown in FIG. 2, $$X_1(t)=\cos[n_1\cdot\Delta t]$$

$$Y_1(t)=\sin[n_1\cdot\Delta t]$$

$$X_2(t)=Y_2(t)=n_2\cdot\Delta t$$

$$n_1\neq n_2$$

and $$X(t)=X_1(t)\cdot X_2(t)$$

$$Y(t)=Y_1(t)\cdot Y_2(t)$$

It will be easily understood that the value of $(n_1-n_2)$ determines $\beta$.

Using this method, the picture forming elements on the spiral raster consist of circular arcs each having a constant central angle. Thus the length of the axes will increase as the radius increases. Although this method is suitable for representation of a radial pattern, it is not optimum for the representation of a pattern whose outline is constituted by horizontal lines and vertical lines.

This method can be improved by a technique that divided the circular arcs such that they are of a constant length. Thus the arcs on the outside spiral raster are divided by smaller angles to produce the short ones.

However, preferred method, is shown in FIGS. 3 and 4. The spiral raster is divided like a lattice by the straight lines which are parallel to the X and Y axes. Numbers are given to the divided segments from the central point. Its number N is used as a parameter and it is assumed that $$X_1(t)=\cos t$$

$$Y_1(t)=\sin t$$

$$X_2(t)=Y_2(t)=t$$

$$X(t)=X_1(t)\cdot X_2(t)$$

$$Y(t)=Y_1(t)\cdot Y_2(t)$$

then the values of $X_1(t)$, $Y_1(t)$, $X_2(t)$, and $Y_2(t)$ are recorded on the ROM as the data using N as an address. With this method, the outline of the pattern constituted by the horizontal and vertical lines becomes straight lines when $\beta=0$.

The above-mentioned functions correspond to the previously mentioned functions in expressions (7): however, it is of course possible to use other functions which correspond to other mathematical formula to generate the required figures.

One embodiment of an apparatus which can be used to perform the present invention using the above-described functions will be described hereinbelow with reference to FIG. 5.

In the drawing, a reference numeral 1 denotes a central-processing-unit (hereinafter, refered to as "CPU"); 2 is a read-only-memory (hereinafter, referred to as "ROM") in which programs and picture data or the like necessary for the display have been recorded; 3 is an random-access-memory (hereinbelow, referred to as a RAM) which is available at all times during the operation; 4 is a spiral raster generator consisting of a ROM, 5, for generating functions, function registers 6, 7, 8, and 9, and multipliers 10 and 11; 12 is a magnification setting device; 13, 14, 15, and 16 are digital-to-analog converters; 17 and 18 are adders; 19 is a video signal generator; 20 is a CRT display; 21 is a console for operation; and 22 is an encoder.

The CPU 1 takes in the necessary data from the ROM 2 and generates control signals necessary for display in response to an input from the console 21. These control signals consist of firstly a raster generation signal group which is sent to the spiral raster generator 4, magnification setting device 12, and digital-to-analog converters 15 and 16 respectively, and secondly a video control signal train which is sent to the video signal generator 19.

The previously mentioned criterion functions have been recorded in the ROM, 5, acting as a function generator, and its data is read out with a phase difference to be given from the CPU, 1, for every function during the period when one spiral raster is being scanned.

The data to be read out for these function registers 6 and 7 are respectively $$X_1(t)=\cos t$$

$$X_2(t)=t$$

and the data to read out for the registers 8 and 9 are respectively $$Y_1(t)=\sin t$$

$$Y_2(t)=t$$

On the other hand, the multipliers 10 and 11 perform the multiplications such as $$X(t)=X_1(t)\cdot X_2(t)=t_1\cdot\cos t_2$$

$$Y(t)=Y_1(t)\cdot Y_2(t)=t_1\cdot\sin t_2$$

and then transfer the results to the digital-to-analog converters 13 and 14.

These inputs can be written as follows:

$$X(t)=t\cdot\cos[\omega_0\cdot t+\beta]$$

$$Y(t)=t\cdot\sin[\omega_0\cdot t+\beta]$$

The D/A converters 13 and 14 convert these inputs into the analog values, the conversion magnifications are given by the CPU 1 and their outputs respectively corresponding to the sine wave portions of expressions (7), i.e.

$$F_0\cdot t\cdot\cos[\omega_0\cdot t+\beta]$$

$$F_0\cdot t\cdot\sin[\omega_0\cdot t+\beta]$$

In addition, the values of the central point ($X_0$, $Y_0$) of the raster are also simultaneously given from the CPU 1 and are converted into the analog values by the D/A converters 15 and 16. These values are then added to the outputs of the D/A converters 13 and 14 by the adders 17 and 18, so that the outputs shown in expression (7) are obtained, i.e.

$$X(t)=X_0+F_0\cdot t\cdot\cos[\omega_0\cdot t+\beta]$$

$$Y(t)=Y_0+F_0\cdot t\cdot\sin[\omega_0\cdot t+\beta]$$

The above mathematical expressions for the X-axis and Y-axis deflection voltages describe voltages beginning at a time, t=0, and that would produce a deflection of the CRT electron beam that would cause a spiral to be traced out on the screen wherein the spot would move in a clockwise direction around the central point determined by the voltage $X_o$ and $Y_o$. If voltages corresponding to the expressions $$X(t)=X_o+F_o\cdot t\cdot\mathrm{Cos}[\omega_o\cdot(t_o-t)+\beta]$$

and $$Y(t)=Y_o+F_o\cdot t\cdot\mathrm{Cos}[\omega_o\cdot(t_o-t)+\beta]$$

where $0\leqq t\leqq t_o$ were caused to be generated in response to outputs from the CPU 1, the spiral could be made to rotate in the opposite direction and then cut-off or blank out when $t=t_o$.

On the other hand, the video signal generator 19 generates a required video signal synchronously with the generation of the previously mentioned spiral raster.

The outputs of the adders 17 and 18 are applied to the deflection coil of the CRT display 20 and the output of the video signal generator 19 is given to the control grid to control the luminance or intensity.

As the deflection coil circuit is a LR circuit, a phase difference appears between applied voltage across deflection coil and real current through said coil, therefore said video signals should not be synchronized with said applied voltage for deflection coil control but said current.

Said delay of phase is proportional to the frequency of the deflection coil voltage waves, and in the case of constant tangental velocity scanning, said frequency is in inverse ratio to the radius of the spiral scan line. The difference in phase, is therefore inversely proportional to radius of spiral scan line.

This illustrates the fact that length of spiral scan line corresponding said difference of phase angle is constant and that the time lag between the deflection coil voltage and current is not dependent upon said frequency of the deflection voltage, but is constant.

Therefore, if the output signals of the video signal generator 19 are synchronously generated with the applied voltage across the deflection coil, the output signals should be applied to the control grid of CRT 20 after a delay time which is equal to the time lag, otherwise, the displayed pattern will be distorted.

Said delay of time might be given by a delay circuit which is inserted between the video signal generator 19 and the control grid of CRT 20, or by delaying output signal of CPU 1 for controlling the video signal generator 19.

It can be easily understood that: the raster moves when the numeric values to be given from the CPU 1 to the D/A converters 15 and 16 change; the pattern is enlarged or reduced when the magnification to be given to the magnification setting device 12 changes; and the pattern rotates with the raster by changing the value of $(t_1 - t_2)$ mentioned before.

With respect to the functions which are to be recorded in the ROM 5, other various known functions as well as the functions which have already been mentioned can be used within the scope of the objective of the present invention.

Since the present invention is constituted as described above, according to the present invention, a number of colorful and brilliant patterns can be simultaneously generated on the CRT display and these patterns can be freely moved, enlarged, reduced, and rotated by a simple circuit constitution.

Figure 5:
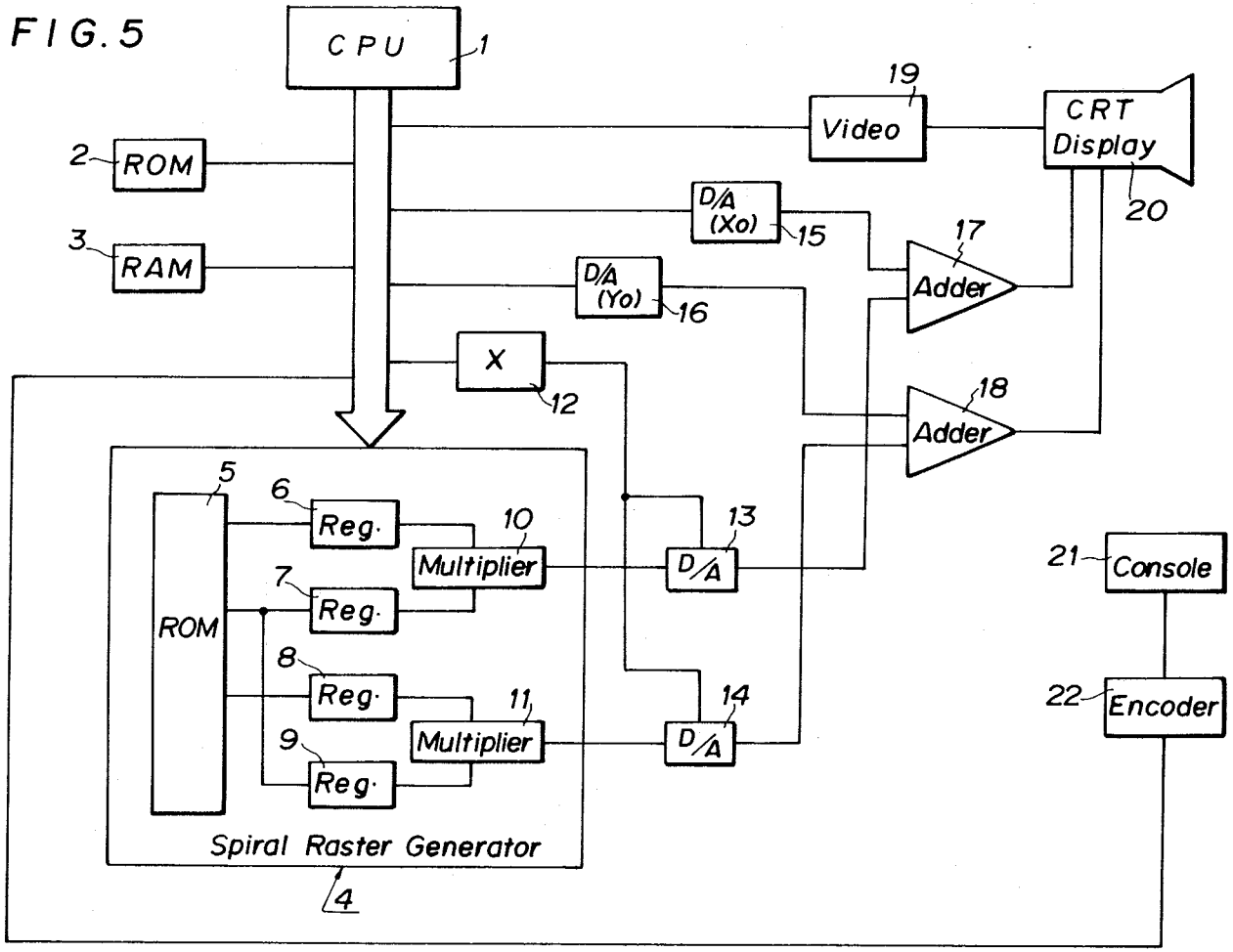
FIG. 5 is a circuit diagram showing one embodiment of a picture displaying apparatus according to the present invention.

To carry this out the CPU 1 of FIG. 5 would be programmed to (1) determine a plurality of starting points on said screen, (2) determine a sequence of said plurality of starting points, (3) determine the shape, phase, linear density and scanning speed of each spiral raster (which may diverge from or converge toward the central point of the spiral), (4) determine pattern data for specifying a luminance of each point of each of said spiral rasters, thereby determining the pattern to be displayed, (5) sequentially scanning the spiral raster corresponding to the respective starting points by the electron beam in accordance with said determined sequence, and controlling an intensity of said electron beam in response to said pattern data, thereby generating the pattern corresponding to each of said starting points; and (6) controlling a shape, phase and scanning speed of said spiral raster corresponding to each of said starting points, thereby enlarging, reducing, modifying, or rotating the patterns displayed on the screen.

Furthermore, the constitution of the present invention is not limited to the above-described embodiments. Namely, the gist of the present invention is that: the horizontal and vertical deflections are controlled by the sine waves; the amplitudes, frequencies and phase difference of them are controlled; thereby producing a spiral raster and then arbitrarily moving, enlarging, reducing, and rotating it. Therefore, it is possible to freely change the technical means with respect to the method of generating sine waves, controlling method, shapes of rasters, etc. within the range of the objects of the present invention.

Although the present invention has been shown and described with respect to particular embodiments, various changes and modifications which are obvious to those skilled in the art to which the invention pertains are deemed to lie within the spirit and scope of the invention. Therefore, the scope of the present invention has to be determined on the basis of the disclosure within the purview of the appended claims.

What is claimed is:

1. A game comprising:

a screen, a console, a read-only memory in which a program for the game, and picture data for display on said screen, have been recorded, a central processing unit which receives signals from said memory, and generates control signals for controlling the display on said screen in response to an input from said console, means for producing time-spaced illuminated spots on said screen, scanning means under the control of said central processing unit for producing a picture by positioning a first group of said spots on said screen along a first spiral path with each spot occurring at a distance along said path which is directly related to the elapsed time of occurrence of the spot, for thus displaying a picture at the location of the first spiral path, said scanning means producing a second picture by further positioning a second group of said time-spaced illuminated spots along a second spiral path on said screen with each spot of said second group being positioned along said second spiral path at a distance directly related to the elapsed time of occurrence of the spot for thus displaying a picture at the location of the second spiral path, said first and second spiral paths occurring at different locations on said screen, and the second one occurring sufficiently soon after the first one that the pictures at the two different locations appear simultaneously to the human eye, said pictures being at least a part of said game.

2. Apparatus as defined in claim 1 comprising:

said screen, said first-named means, and said scanning means comprising a cathode ray tube that has an electron beam generator directing a beam of electrons at said screen, said scanning means producing a beam deflecting field which, if the beam was a continuous one, would deflect the continuous beam along said first spiral path and subsequently deflect such continuous beam along a second spiral path which is in a different position on said screen than the first spiral path.

3. Apparatus as defined in claim 2 in which said scanning means includes means for moving the location of at least one or said said spiral paths thereby moving one of said pictures.

4. Apparatus as defined in claim 2 in which said scanning means includes means for changing the size of at least one of said spiral paths to thereby change the size of at least one of said pictures.

5. Apparatus as defined in claim 2 in which said scanning means includes means for rotating at least one of said pictures.

6. Apparatus as defined in claim 2 in which said scanning means includes means for (a) changing the size of, (b) moving, and (c) rotating, at least one of said spiral paths to thereby change the size of, move, and rotate one of said pictures.

7. A game which displays pictures on a screen comprising:

a cathode ray tube having said screen, beam producing means, and beam deflecting means, a central processing unit with memory means programmed to function as a game, a console for controlling said central processing unit, means for feeding scanning signals to said beam deflecting means for producing a scanning path comprising a first spiral path at one location on said screen and a second spiral path at another location on said screen with the scan of the second spiral path being subsequent to the scan of the first spiral path, and means, including said central processing unit, for feeding signals to said beam producing means, which are synchronized with said scanning signals, for producing a beam at selected intervals along said first and second spiral paths and for thereby displaying a picture along said first spiral path and displaying a picture along said second spiral path, said second spiral path being scanned sufficiently soon after said first spiral path is scanned that the pictures displayed along the first and second spiral paths appear simultaneously to a human eye looking at said screen, said game including said pictures.

8. Apparatus as defined in claim 7 in which said memory means includes a read-only memory, said central processing unit addressing said read-only memory to read out the signals for controlling said beam producing means.

9. Apparatus as defined in claim 8 in which said central processing unit sychronizes said scanning signals with the output of said read-only memory.

10. Apparatus as defined in claim 7 in which said scanning means includes magnifying means for changing the size of at least one of said spiral paths to thus change the size of at least one of said pictures.

11. Apparatus as defined in claim 7 in which said scanning means includes means for moving the location of at least one of said spiral paths to thereby move at least one of said pictures.

12. Apparatus as defined in claim 7 in which said scanning means includes means for rotating at least one of said spiral paths to thereby rotate at least one of said pictures.

13. Apparatus as defined in claim 7 in which said scanning means includes means for (a) changing the size of (b) moving and (c) rotating, one of said spiral paths thereby changing the size of, moving and rotating at least one of said pictures.

14. The method of performing a game with a beam for producing a plurality of pictures on a screen comprising:

producing a scanning field which would cause said beam, to trace in a first location on said screen, a first spiral path, if the beam was a continuous one, modulating the first-named beam, during the occurrence of said scanning field, for providing the first-named beam with sufficient amplitude at particular times, during the occurrence of said scanning field, for sufficiently illuminating the screen to display a visual picture in said first location, producing a scanning field which would cause said beam, to trace a second spiral path, in a second location on said screen, if the beam was a continuous one, modulating the first-named beam, during the occurrence of said second scanning field, for providing the first-named beam with sufficient amplitude at particular times, during the occurrence of the last-named scanning field, for sufficiently illuminating the screen to display a visual picture in said second location, said second scanning field occurring so soon after the first one that the two pictures appear, to the human eye, simultaneously, and controlling said scanning field and said beam to play the game.

15. The method of claim 14, including:

providing said screen with material that is illuminated when bombarded with said beam, said scanning step further comprising moving said beam along the convolutions of said first spiral path and then moving said beam along the convolutions of said second spiral path; whereby to provide said spiral paths.

16. The method of claim 14, comprising selecting first and second points which determine the locations of said first and second spiral paths, respectively; one of said points, and its complementary spiral path, being moved on said screen to thereby move one of said pictures.

17. The method of claim 14, which further comprises changing the size of one of said spiral paths to thus change the size of the picture complementary to said one spiral path.

18. The method of claim 14 which includes modifying at least one of said pictures.

19. The method of claim 14 which includes the steps of (a) determining at least first and second points on said screen, (b) using said first point to determine the location of said first spiral path and (c) using said second point to determine the location of said second spiral path.

20. The method of claim 14 which includes changing the size of, moving and rotating at least one of said spiral paths to thereby change the size of, move and rotate at least one of said pictures.

* * * * *